US005464180A

United States Patent [19]

Cheng

[11] Patent Number: 5,464,180

[45] Date of Patent: Nov. 7, 1995

[54] SUPPORT SET OF GOLF CLUB BAG

[76] Inventor: Der-Bin Cheng, No. 70, Su Chie Road, Wan Lee Township, Mau Li Hsien, Taiwan

[21] Appl. No.: 330,067

[22] Filed: Oct. 26, 1994

[51] Int. Cl.[6] ..... A63B 55/00

[52] U.S. Cl. ..... 248/96; 206/315.7; 248/688

[58] Field of Search ..... 248/96, 688, 351, 248/434, 435; 206/315.7, 315.3, 315.4

[56] References Cited

U.S. PATENT DOCUMENTS

| | | | |
|---|---|---|---|
| 1,170,891 | 2/1916 | Graf | 248/96 |
| 1,970,849 | 8/1934 | Gunther | 248/96 |
| 1,978,230 | 10/1934 | Schutes | 248/96 |
| 2,672,311 | 3/1954 | Schiele | 248/96 |
| 4,798,357 | 1/1989 | Cho | 206/316.7 X |
| 5,351,921 | 10/1994 | Chen | 248/96 |

*Primary Examiner*—Karen J. Chotkowski
*Attorney, Agent, or Firm*—Browdy and Neimark

[57] ABSTRACT

A golf club bag support set comprises a fixation member, two rod members, a sliding member, two first elastic members, two second elastic members, an urging member, and a bottom plate. The sliding member is forced to move upwards when the urging member is pushed upwards, thereby resulting in the disengagement of the stopping portion of the sliding member with the outer edges of the top ends of the two rod members. The lower ends of the two rod members are forced by the two second elastic members to swing outwards such that the tips of the lower ends swing outwards, thereby causing the tips of the lower ends of the two rod members and the bottom of the golf club bag to make contact with the ground so that the bag is set obliquely and securely on the ground.

5 Claims, 4 Drawing Sheets

SUPPORT SET OF GOLF CLUB BAG

FIELD OF THE INVENTION

The present invention relates generally to a golf club bag, and more particularly to a golf club bag provided with a support set enabling the golf club bag to sit on the ground obliquely.

BACKGROUND OF THE INVENTION

The conventional golf club bag of a cylindrical construction is provided with an open top through which a plurality of golf clubs are put into the bag which is further provided with a shoulder strap to facilitate the carrying of the bag. The construction of the bottom of the golf club bag is such that the bag can be placed upright on the ground. Such a conventional golf club bag as described above is defective in design in that the golf clubs, which are kept in the bag sitting upright on the ground, can not be selected easily and conveniently by a player.

Some golf club bags are therefore provided with two support legs pivoted thereto. These two support legs are so constructed that they permit the golf club bags to sit on the ground obliquely so as to facilitate the selection of the golf clubs which are kept in the bags.

SUMMARY OF THE INVENTION

It is therefore the primary objective of the present invention to provide a golf club bag with a support set enabling the golf club bag to sit obliquely on the ground.

The foregoing objective of the present invention is attained by a golf club bag support set, which comprises a fixation member, a pair of rod members, a sliding member, two first elastic members, two second elastic members, an urging member, and a bottom plate. The sliding member is forced to move upwards when the urging member is pushed upwards, thereby resulting in the disengagement of the stopping portion of the sliding member with the outer edges of the top ends of the two rod members. In the meantime, the lower ends of the two rod members are forced by the second elastic members to swing outwards such that the tips of the lower ends swing outwards, thereby causing the tips of the lower ends of the two rod members and the bottom of the bag to make contact with the ground so that the bag is sat obliquely on the ground.

DETAILED DESCRIPTION OF THE INVENTION

Figure 1:
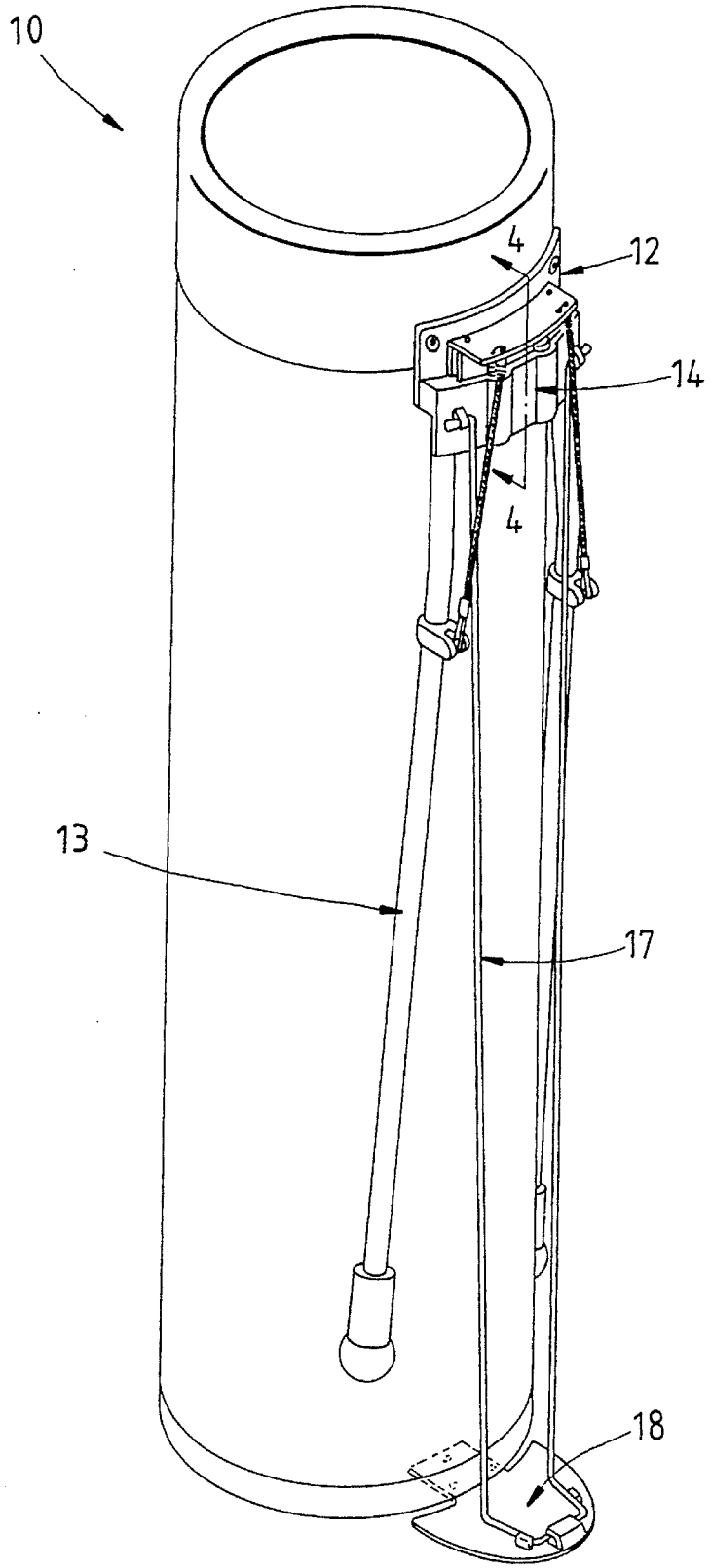
FIG. 1 shows a perspective view of the present invention with its support set being contained.

As shown in FIGS. 1–5, a golf club bag support set 10 of the present invention is composed of a fixation member 12, a pair of rod members 13, a sliding member 14, a pair of first elastic members 15, a pair of second elastic members 16, an urging member 17, and a bottom plate 18.

The fixation member 12 is fastened to the outer edge of the top of a golf club bag 11 and is provided with a first body 20 and a stopping piece 26. The first body 20 of an appropriate thickness is provided on the outer side thereof with a pair of first slots 22 which are spaced approriately. The first body 20 is provided respectively in both sides thereof with a sliding slot 24 of an appropriate length. The stopping piece 26 is fastened to the first body portion 20 by a pair of screws 28 such that the stopping piece 26 covers the first slots 22, and that the outer side of the stopping piece 26 extends beyond the first body 20. The stopping piece 20 is provided with a plurality of hooking holes 29.

The rod members 13 are pivoted respectively to both sides of the lower end of the first body 20 and are provided respectively near the top end thereof with a curve portion 30 near which a pair of connection members 32 are fastened.

The sliding member 14 is mounted on the fixation member 12 such that sliding member 14 can be caused to move upwards and downwards. The sliding member 14 is provided with a second body 40, which can be attached to the outer side of the first body 20 and is provided with pair of second slots 42 having respectively a bottom portion 43. The second body 40 is further provided with a pair of retaining blocks 44 which are in turn provided respectively with a projection 45 corresponding in location to the sliding slot 24. The second body 40 is further provided respectively on the outer sides of both ends thereof with a pivoting portion 46 having a through hole 47 extending horizontally. The second body is still further provided with a stopping portion 48 extending downwards and corresponding in location to the outer side of the top end of the rod member.

Each of the two first elastic members 15 is a coil spring and is received in the first slot 22 and the second slot 42 such that the top end and the bottom end of the first elastic member 15 urge respectively the lower edge of the stopping piece 26 and the upper edge of the bottom portion 43 of the second slot 42. The first elastic member 15 is capable of forcing the sliding member 13 to move downwards.

Each of the two second elastic members 16 is provided with a top end which is held in the hooking hole 29 of the stopping piece 26, and with a bottom end which is retained at the end of the connection member 42.

The urging member 17 is provided at the lower end thereof with a first extension portion 70. The urging member 17 is further provided respectively at two upper ends thereof with a second extension portion 72, which is pivoted to the through hole 47 of the pivoting portion 46.

The bottom plate 18 has an inner side 80 which is fastened to the bottom of the golf club bag 11. The bottom plate 18 further has an outer side 82 extending beyond the bottom of the golf club bag 11. The outer side 82 can be caused to swing upwards and downwards on an axis located at the junction between the outer side 82 and the inner side 80. The outer side 82 is provided with a hooking member 84 capable of holding the first extension portion 70 of the urging member 17.

Figure 4:
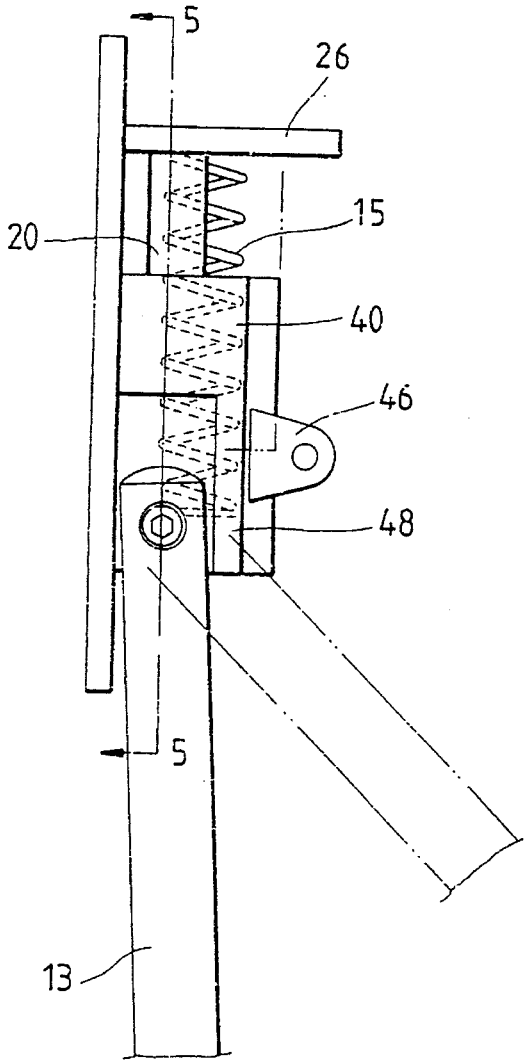
FIG. 4 shows a sectional view of a portion taken along the line 4—4 as shown in FIG. 1.
Figure 5:
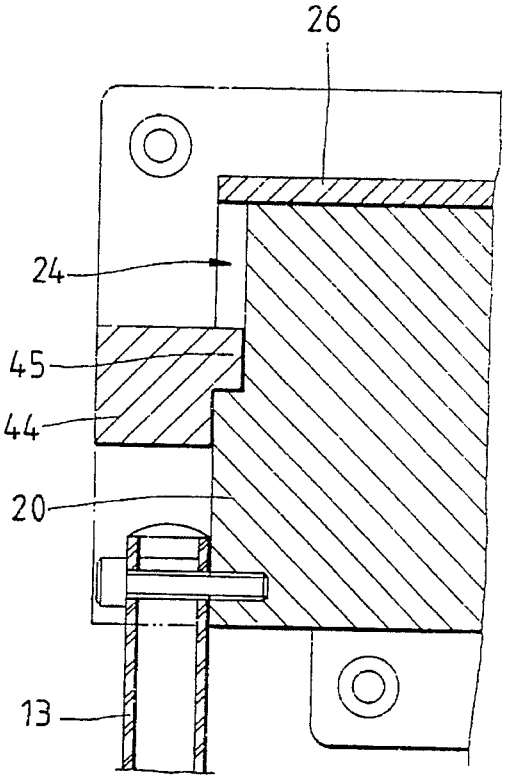
FIG. 5 shows a sectional schematic view of a portion taken along the line 5—5 as shown in FIG. 4.

When the golf club bag 11 is set upright on the ground, the two first elastic members 15 are not exerted on by an external force and are capable of forcing the sliding member 14 to slide downwards. In the meantime, each of the two rod members 13 is forced by the stopping portion 48 of the sliding member 14 to swing inwards to attach to the golf club bag 11, as shown in FIGS. 1 and 4.

When the golf club bag 11 is to be sat obliquely on the ground, the golf club bag 11 is first tilted in the direction toward the support set 10. As a result, the outer side 82 of the bottom plate 18 is set on the ground while the inner side

Figure 2:
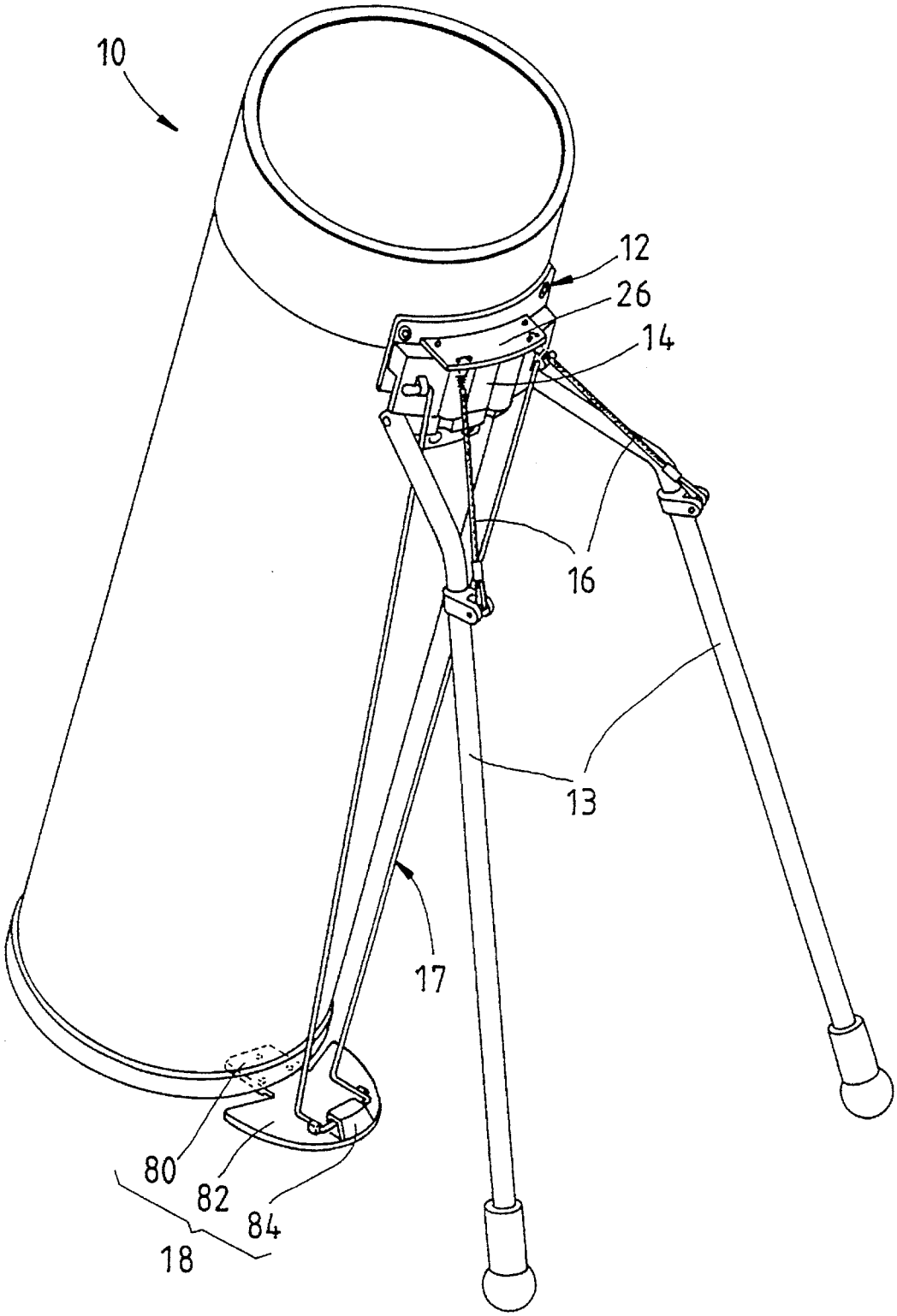
FIG. 2 shows a perspective view of the present invention with its support set being released.
Figure 3:
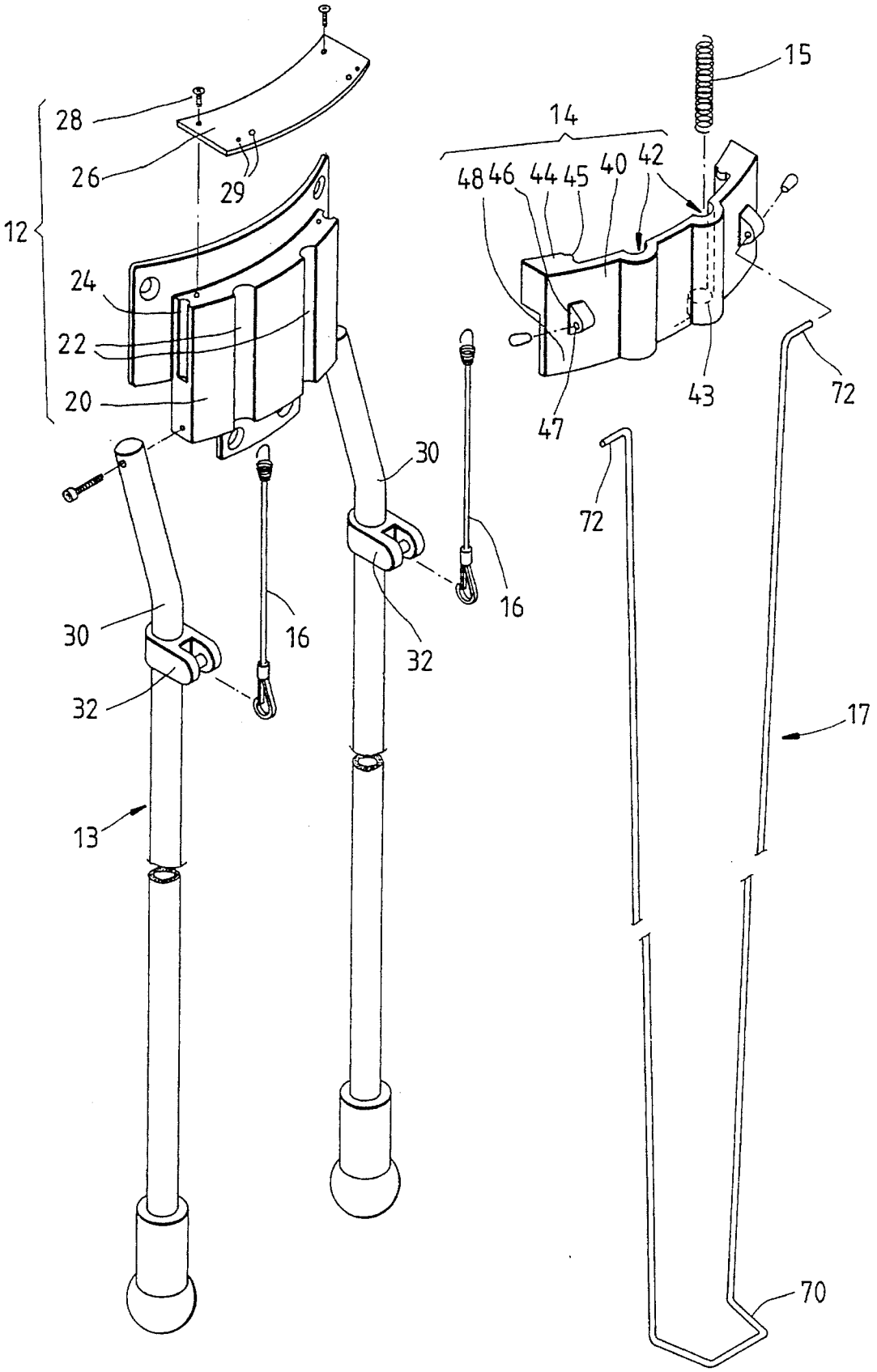
FIG. 3 shows an exploded view of the present invention.

80 of the bottom plate 18 is caused to swing upwards along with the tilting of the golf club bag 11, thereby resulting in a gradual reduction in the distance between the sliding member 14 and the bottom plate 18. The sliding member 14 is therefore caused by the urging member 17 to push the two first elastic members 15 to move upwards, thereby bringing about the disengagement of the stopping portions 48 with the two rod members 13. In the meantime, the two rod members 13 are pulled by the two second elastic members 16 to swing outwards. The extent to which the two rod members 13 are caused to swing outwards is directly proportional to the tilting angle of the golf club bag 11. As shown in FIG. 2, the golf club bag 11 is set obliquely and securely on the ground.

What is claimed is:

1. A golf club bag support set comprising:

a fixation member fastened to a golf club bag;

two rod members spaced at a predetermined interval and pivoted to said fixation member;

a sliding member mounted slidably on said fixation member and provided with a stopping portion extending downwards to rest against an outer edge of a top end of each of said two rod members;

a first elastic members disposed between said fixation member and said sliding member such that said two first elastic members can force said sliding member to slide downwards;

two second elastic members disposed between said sliding member and said rod members such that said rod members can be forced by said two second elastic members to swing outwards; and an urging member fastened at one end thereof with said sliding member such that said sliding member is actuated to move upwards by said urging member which is exerted on by an external force, thereby bringing about the disengagement of said stopping portion with said two rod members which are then pulled by said two second elastic members to swing outwards so as to enable said golf club bag to sit obliquely on the ground.

2. The golf club bag support set according to claim 1 wherein said urging member is pivoted at a top end thereof to said sliding member.

3. The golf club bag support set according to claim 2 comprising a bottom plate having an outer side capable of swinging upwards and downwards outside a bottom portion of said golf club bag, said outer side being fastened with a bottom end of said urging member.

4. The golf club bag support set according to claim 1 wherein said fixation member is provided with a first slot; wherein said sliding member is provided with a second slot corresponding in location to said first slot; and wherein said stopping portion is located over said first slot; and wherein said first elastic member is disposed between said first slot, said second slot, and said stopping portion.

5. The golf club bag support set according to claim 1 wherein said fixation member is provided respectively in both sides thereof with a retaining slot; and wherein said sliding member is provided with two projections corresponding in location to said retaining slots.

* * * * *